US006472137B1

(12) United States Patent
Verbeeck et al.

(10) Patent No.: US 6,472,137 B1
(45) Date of Patent: Oct. 29, 2002

(54) LIGHT-SENSITIVE SILVER HALIDE PHOTOGRAPHIC FILM MATERIAL AND RADIOGRAPHIC INTENSIFYING SCREEN-FILM COMBINATION

(75) Inventors: Ann Verbeeck, Begijnendijk; Paul Callant, Edegem; Freddy Henderickx, Olen, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/709,628

(22) Filed: Nov. 13, 2000

Related U.S. Application Data

(60) Provisional application No. 60/169,289, filed on Dec. 7, 1999.

(30) Foreign Application Priority Data

Nov. 26, 1999 (EP) ..... 99204009

(51) Int. Cl.[7] ..... G03C 1/005

(52) U.S. Cl. ..... 430/567; 430/569; 430/591; 430/966

(58) Field of Search ..... 430/567, 569, 430/966, 591

(56) References Cited

U.S. PATENT DOCUMENTS

| | | | | | |
|---|---|---|---|---|---|
| 3,850,645 | A | * | 11/1974 | Herz et al. | 96/114.7 |
| 4,977,076 | A | * | 12/1990 | Okazaki et al. | 430/583 |
| 5,107,125 | A | * | 4/1992 | Powell et al. | 250/483.1 |
| 5,259,016 | A | * | 11/1993 | Dickerson et al. | 378/186 |
| 5,468,599 | A | * | 11/1995 | Biavasco et al. | 430/512 |
| 5,474,881 | A | * | 12/1995 | Slater et al. | 430/506 |
| 5,965,318 | A | * | 10/1999 | Goedeweeck et al. | 430/139 |
| 5,989,799 | A | * | 11/1999 | Verbeeck et al. | 430/567 |
| 6,200,743 | B1 | * | 3/2001 | Elst et al. | 430/576 |
| 6,238,853 | B1 | * | 5/2001 | Baecke et al. | 430/445 |
| 6,277,551 | B1 | * | 8/2001 | Vandenbroucke | 430/567 |

FOREIGN PATENT DOCUMENTS

| | | |
|---|---|---|
| EP | 0 345 483 A3 | 12/1989 |
| EP | 0 345 483 A2 | 12/1989 |
| EP | 0 890 873 A1 | 1/1999 |
| EP | 0 953 867 A1 | 11/1999 |

OTHER PUBLICATIONS

Derwent Publications Ltd., London, GB, Section Ch, Week 199841, Class E23, AN 1998–471434, XP002137920 & JP 10–197979A (Fuji Photo Film Co. Ltd.), Jul. 31, 1998 (Abstract).

* cited by examiner

*Primary Examiner*—Janet Baxter
*Assistant Examiner*—Amanda C. Walke
(74) *Attorney, Agent, or Firm*—Breiner & Breiner, L.L.C.

(57) ABSTRACT

A light-sensitive silver halide photographic film material has been provided, said film material comprising a transparent support and on both sides thereof at least one light-sensitive emulsion layer having spectrally and chemically sensitized tabular silver halide grains rich in silver bromide, further having silver iodide in an amount of less than 3 mole % based on silver, with two flat parallel {111} crystal faces, said grains accounting for a total projective surface of said parallel crystal faces in said emulsion of at least 50%, further having an average aspect ratio of at least 2:1, a grain thickness of from 0.05 up to 0.15 $\mu$m, a site-directing azacyanine compound satisfying the general formulae disclosed herein in an amount of not less than $1\times10^{-4}$ mole per mole of silver halide coated and one or more J-aggregating spectrally sensitizing dye(s), wherein a molar ratio amount between said site directing compound and said J-aggregating spectrally sensitizing dye(s) is at least 1:6 for a grain coverage of said {111} tabular grains exceeding 50%.

A radiographic screen/film combination has also been described comprising said light-sensitive silver halide photographic film material and two supporting or self-supporting X-ray intensifying screens) comprising luminescent phosphors, wherein by contacting the film material with a sandwich of a pair of said intensifying screens and exposing said combination to X-rays, emission of radiation by said luminescent phosphors in the wavelength range for which said material has been made spectrally sensitive provides a black-and-white diagnostic image after processing of said exposed radiographic film material.

9 Claims, No Drawings

LIGHT-SENSITIVE SILVER HALIDE PHOTOGRAPHIC FILM MATERIAL AND RADIOGRAPHIC INTENSIFYING SCREEN-FILM COMBINATION

This application claims benefit of Provisional Application Serial No. 60/169,289 filed Dec. 7, 1999.

FIELD OF THE INVENTION

This invention relates to a radiographic light-sensitive silver halide photographic film material having thin tabular {111} hexagonal grains rich in silver bromide, a combination of two radiographic intensifying luminescent phosphor screens with said film material and a black-and-white diagnostic image forming method after exposure of said screen/film combination with X-rays.

BACKGROUND OF THE INVENTION

Since the early eighties practical use of light-sensitive silver halide grains or crystals has become common knowledge for is anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 $\mu$m as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,59.5,864.

In radiographic applications the film materials are coated with relatively high amounts of silver, in order to provide a suitable sensitometry even if a low radiation dose is applied to the patient as is always desirable. Use of {111} tabular silver halide grains permits coating of lower amounts of silver if compared e.g. with grains having a more globular shape as applied before practical application of said tabular grains. Within the {111} tabular grains those showing a higher "tabularity" (defined as ratio between aspect ratio and grain thickness) are even more in favour of lower coating amounts of silver halide, but the need to provide an acceptable image tone after development of such materials having light-sensitive silver halide layers containing said tabular grains having high tabularity is even more stringent: reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images.

Measures taken in order to get a shift in image tone from reddish-brown to the desired bluish-black color of the developed silver, well-known from the state-of-the-art are hitherto unsatisfactory. Coating light-sensitive emulsion layers on a blue base as in U.S. Pat. No. 5,800,976 makes increase minimum density, a phenomenon which is interpreted by the radiologist as an undesired increase of fog density. Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen, with residual color of dyes due to uncomplete removal of said dyes in nowadays desired rapid processing cycles and problems related with criticality of generation of imagewise developed blue colored silver and preservation characteristics of the material.

Another disadvantage of ultrathin tabular grains is related with the increased total specific grain surface and the need to provide huge amounts of suitable spectral sensitizers in order to reach the desired sensitometric characteristics. So the attainable speed is, besides a probable shift in the exposure light absorption spectrum which can be expected, highly dependent on adsorption characteristics of the spectral sensitizer(s) in the required high concentrations and on the development inhibiting properties of the grain covered with the spectral sensitizer(s), moreover present in the said huge amounts. Especially the said development inhibiting properties (leading to desensitization phenomena) may lay burden on the attainable sensitometric characteristics, inclusive for covering power and residual color after processing. Moreover the effect on image tone for those thin tabular grains and on decolorizing properties in the processing, again due to the use of large amounts of spectral sensitizer, is unknown and may become a stringent problem when rapid processing is required, especially in ecological processing systems wherein replenishment is reduced to a minimum in order to get as low amounts of chemical waste as possible.

Last but not least lowering of coating amounts of silver halide in silver halide photographic materials may not lead to loss in image quality due to increased cross-over percentages measured for double side-coated photographic materials, especially for those spectrally sensitized in the green wavelength range of the visible light spectrum, normally expected to show lower image definition than those spectrally sensitive to radiation in the blue to ultraviolet wavelength range. As light absorption by the spectral sensitizer should not be lowered when lowering coated amounts of silver halide, amounts of spectral sensitizer should be increased which perfectly matches with the requirements as set forth above for tabular grains having a high tabularity. Moreover high amounts of spectral sensitizer for such grains is closely related with the need for suitable site-directing action of said sensitizer in order to provide an optimized chemical sensitization without further loss processes.

OBJECTS OF THE INVENTION

Therefore there is, as a first object of the present invention, a stringent demand to get a desired blue-black image tone, even when a higher covering power is measured for a processed film providing a diagnostic image provided by duplitized radiographic materials coated with light-sensitive layers having thin tabular grains with a thickness of at most 0.15 $\mu$m.

It is a second object to reduce to a minimum level the residual color of the diagnostic black-and-white image obtained after processing of the radiographic light-sensitive silver halide film material having stored the latent image of the subject to be examined.

It is a third object of the present invention to provide suitable sensitometric characteristics for the film material, more particularly a high speed.

It is still a further object of the present invention to provide a good image quality reflected in low cross-over percentages. Further objects will become apparent from the description hereinafter.

SUMMARY OF THE INVENTION

In order to reach the objects of the present invention a light-sensitive silver halide photographic film material has been provided, said material comprising a transparent support and on one or both sides thereof at least one light-sensitive emulsion layer having spectrally and chemically sensitized tabular silver halide grains rich in silver bromide, further having silver iodide in an amount of less than 3 mole % based on silver, with two flat parallel {111} crystal faces, said grains accounting for a total projective surface of said parallel crystal faces in said emulsion of at least 50%, further having an average aspect ratio of at least 2:1, a grain thickness of from 0.05 up to 0.15 $\mu$m, a site-directing compound satisfying general formulae (I.1) or (I.2) as described hereinafter in the detailed description and in the claims in an amount of not less than $1\times10^{-4}$ mole per mole of silver coated and one or more J-aggrega-ting spectrally sensitizing dye(s), wherein a molar ratio amount between said site directing compound and said J-aggregating spectrally sensitizing dye(s) is at least 1:6 for a grain coverage of said {111} tabular grains exceeding 50% and wherein said site-directing compounds are represented by the formulae (I.1) or (I.2). A radiographic screen/film combination comprising the light-sensitive silver halide photographic film material in combination with a pair of supported or self-supporting X-ray intensifying screens has also been disclosed, wherein said screens essentially consists of luminescent phosphor particles emitting light in the wavelength range for which the film material has been made spectrally sensitive.

Moreover a black-and-white image-forming method providing diagnostic images has also been disclosed, said method comprising the steps of exposing said screen/film material to X-rays passing a subject to be examined, and processing the film material by the steps of developing, fixing, rinsing and drying.

DETAILED DESCRIPTION

In order to attain the full benifits of the present invention for a radiographic film material having thin {111} tabular silver halide grains rich in silver bromide as further described herein it has unexpectedly been found that high amounts, i.a., not less than $1\times10^{-4}$ mole per mole of silver halide coated as claimed, of the site-directing azacyanine compound satisfying the general formula (I) described herein are required in the light-sensitive emulsion layers of the double side coated or duplitized radiographic film material, together with one or more J-aggregating spectrally sensitizing dye(s), wherein a molar ratio amount between said site directing compound and said a J-aggregating spectrally sensitizing dye(s) should be at least 1:6, for a grain coverage exceeding 50%.

Specific azacyanine dyes particularly suitable for use in the emulsions coated in the light-sensitive layers of the material of to the present invention are following, according to the formulae (I.1) or (I.2):

(I.1)

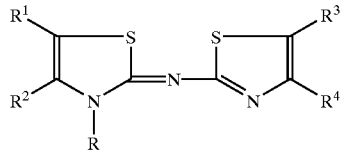

(I.2)

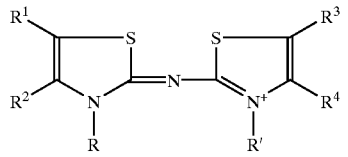

wherein each of the substituents $R^1$–$R^4$ independently represents hydrogen, an (unsubstituted or substituted) alkyl, an (unsubstituted or substituted) aryl or an (unsubstituted or substituted) aralkyl;

wherein $R^1$ and $R^2$ and/or $R^3$ and $R^4$ may form a (substituted or unsubstituted) benzoring, which, if substituted, has the same or different substituents as $R^1$–$R^4$;

wherein R represents an (unsubstituted or substituted) alkyl, an (unsubstituted or substituted) aryl or an (unsubstituted or substituted) aralkyl group;

wherein R' represents hydrogen, an (unsubstituted or substituted) alkyl, an (unsubstituted or substituted) aryl or an (unsubstituted or substituted) aralkyl group;

and wherein cations or anions are present as charge compensating ions.

More particularly preferred each of R and R' independently represents $(CH_2)_nH$ or $(CH_2)_nOH$, n being an integer having a value from 1 to 4, $(CH_2)_m(SO_3^-)$ or $(CH_2)_mO(SO_3^-)$, m being an integer having a value from 2 to 4, $(CH_2)_2CH(Y)SO_3^-$ wherein Y represents $CH_3$—, —Cl or —OH; $(CH_2)_n(COO^-)$ or $(CH_2)_n(COOH)$, $(CH_2)_sSO_2^-(CH_2)_tH$ wherein s equals 2 or 3 and t equals 1 or 2;

$(CH_2)_x$-Phen-W, wherein W represents —COO or $SO_3^-$; Phen represents phenyl which is substituted or unsubstituted; and x equals 1, 2, 3 or 4, $(CH_2)_nCONHSO_2H$, or a latent solubilizing group as, e.g., $(CH_2)_m$—(C=O)—O—$CH_2$—(C=O)—$CH_3$, wherein m' is an integer having a value of from 1 to 5.

In order to get neutral azacyanine structures preferred charge compensating cations are $Li^+$, $Na^+$, $K^+$, $HN^+Et_3$, wherein Et represents ethyl, whereas preferred charge compensating anions are $Cl^-$, $Br^-$, $I^-$, $^-$OTos, $^-$OMes, $CF_3SO_3^-$, wherein $^-$OTos represents tosylate and $^-$OMes represents mesylate.

More specific suitable examples of azacyanine dyes are given in the formulae (I.3) to (I.13) hereinafter:

(I.3)

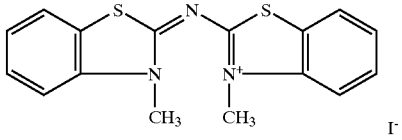

-continued

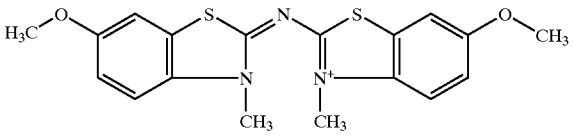

(I.4)

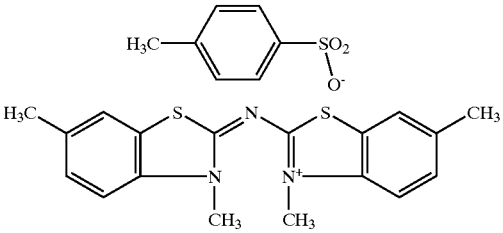

(I.5)

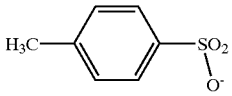

(I.6)

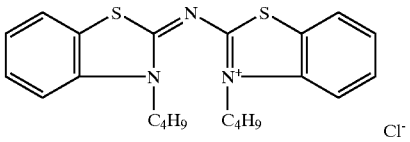

(I.7)

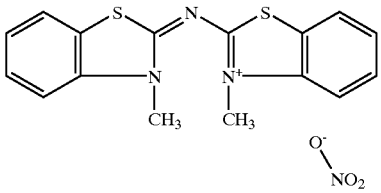

(I.8)

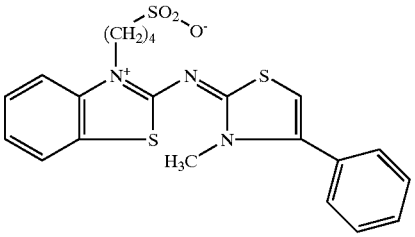

(I.9)

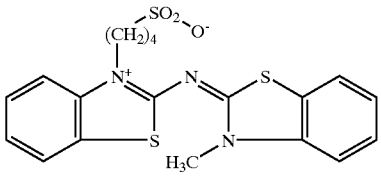

(I.10)

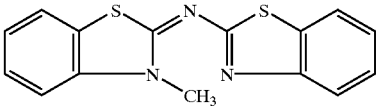

(I.11)

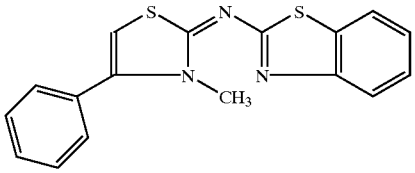

-continued (I.12)

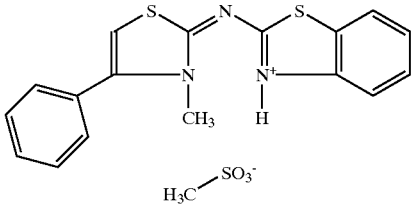

(I.13)

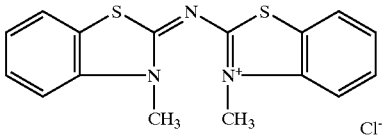

The silver halide photographic film material of the present invention thus comprises a transparent film support having first and second major surfaces coated on one or both sides of the said major surfaces of the support with at least one photosensitive layer overcoated with a protective antistress layer, said photosensitive layer containing in an amount of at least 50%, preferably at least 70% and even more preferably at least 90% of the total projective surface of all grains a light-sensitive emulsion having {111} tabular grains rich in silver bromide, silver iodide being present in an amount of less than 3 mole % based on silver, with an average grain thickness of from 0.05 $\mu$m up to 0.15 $\mu$m, further having, as an essential feature of the present invention, the site-directing azacyanine compound satisfying the general formulae (I.1) or (I.2) as described herein in a high amount of not less than $1\times10^{-4}$ mole per mole of silver halide coated, besides one or more J-aggregating spectrally sensitizing dye(s), wherein a molar ratio amount between said site directing compound and said a J-aggregating spectrally sensitizing dye(s) is at least 1:6 for a grain coverage exceeding 50% and wherein said ratio is even more preferably from 1:3 to 1:1.

Preparation of spectrally and chemically sensitized tabular grains as may be applied to emulsion grains to be coated light-sensitive layers of a radiographic material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

The {111} tabular silver halide emulsion grains, present in light-sensitive emulsion layers of materials according to the present invention, are spectrally sensitized in the blue to near ultraviolet wavelength range and/or green wavelength range, preferably prior to chemical sensitisation, depending on the requirements as set forth by medecins examining radiological images as especially sharpness (low cross-over percentage), but also contrast (which should be a "dedicated contrast" depending on the density range wherein image details should be discernable), speed and density range.

In a particular embodiment of the present invention the duplitized film material comprises in its light-sensitive emulsion layers coated on a subbed support an emulsion having {111} hexagonal tabular grains rich in silver bromide, further having silver iodide in an amount of less than 3 mole % based on silver,spectrally sensitive to irradiation in the green wavelength range, but treated before adsorption of the J-aggregate forming green sensitizing dye(s) with azacyanine dyes in the high amounts set forth in the statement of the present invention.

The radiographic film material according to the present invention thus treated with high amounts of at least $10^{-4}$ mole per mole of silver of the site-directing azacyanine dye(s) according to the general formula (I) becomes spectrally sensitive to irradiation in the green wavelength range between 500 and 555 nm by the further presence of at least one spectrally sensitizing (orthochromatic) dye having a maximum absorption in the wavelength range between 540 and 555 nm and satisifying the general formula (II)

(II)

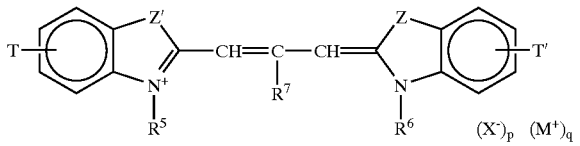

wherein

Z and Z' each independently represents a nitrogen or an oxygen atom and wherein Z is substituted with $R^8$ if Z is a nitrogen atom and Z' is substituted with $R^9$ if Z' is a nitrogen atom;

$R^5$, $R^6$ and $R^8$ and $R^9$ each independently represents substituted or unsubstituted alkyl, $R^7$ represents hydrogen, substituted or unsubstituted alkyl or substituted or unsubstituted aryl, T and T' may each independently represent hydrogen, a substituted or unsubstituted alkyl, a substituted or unsubstituted aryl or a substituted or unsubstituted heterocyclic group;

$(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound.

In a more preferred embodiment in the material according to the present invention the J-aggregating cyanine dye(s) adsorbed at the grain surface of the preferred silver bromoiodide or silver bromochloroiodide {111} tabular hexagonal grains corresponds to the general formula (II) wherein $R^7$ is $—C_2H_5$, Z and Z' are both representing an oxygen atom, at least one of $R^5$ and $R^6$ represents a sulphoalkyl group, preferably corresponding to the formulae $—(CH_2)_nSO_3^-$ wherein n equals 2, 3 or 4, $—(CH_2)_2—CH(CH_3)—SO_3^-$ $—CH_2—CHY'—CH_2—SO_3^-$ wherein Y' represents —OH or —Cl;

a sulphatoalkyl group, preferably corresponding to the formula $—(CH_2)_nOSO_3^-$ wherein n equals 2, 3 or 4, an acylsulphonamido group, preferably corresponding to the formulae $—(CH_2)_n—C(O)—N(R^{10})—SO_2—(CH_2)_mH$ wherein n equals 1, 2 or 3; m equals 1, 2, 3, etc.

$—(CH_2)_r—SO_2—N(R^{10})—SO_2—(CH_2)_sH$ wherein r equals 2, 3 or 4; s equals 1, 2, 3, etc., $—(CH_2)_v—SO_2—N(R^{10})—C(O)—(CH_2)_wH$ wherein v equals 2, 3 or 4; w equals 1, 2, 3, etc.;

a carboxyalkyl group, preferably corresponding to the formula $(CH_2)_xCOOH$ or $(CH_2)_xCOO^-$ wherein x equals 1, 2, 3, etc.;

wherein $R^{10}$ represents H or alkyl; and wherein each of T and T' independently represents hydrogen, 5-phenyl, 5-Cl, 5-$OCH_3$ and 5-$CH_3$.

Still more preferred in the formula (II) each of Z and Z' represents oxygen and each of T and T' represents Cl or, alternatively, T represents Cl and T' represents Phenyl or vice versa and wherein further $R^5$ and $R^6$ represent all combinations of the formulae $—(CH_2)_nSO_3^-$ wherein n equals 2, 3 or 4, $—(CH_2)_2—CH(CH_3)—SO_3^-$ and $—CH_2—CHY—CH_2—SO_3^-$ wherein Y represents —OH or —Cl;

and wherein $R^5$, corresponding to the formulae given above, is combined with $R^6$ corresponding to the formulae $—(CH_2)_jH$ wherein j equals 1, 2, 3 or 4;

$—CH_2$-Phen-$SO_3^-$ $—CH_2$-Phen-COOH $—(CH_2)_k$-Phen-COOH wherein k equals 1, 2 or 3.

$—(CH_2)_l—COOH$, wherein l equals 1, 2 or 3, etc.

In a particularly preferred embodiment said J-aggregating spectrally sensitizing dye is a 5,5'-dichloro-3,3'-bis($SO_3$—R)-9-ethyl-benzoxacarbocyanine with R being n-propylene or n-butylene and more particularly anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyloxa-carbocyanine hydroxide. Furthermore green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related with the purpose of obtaining the highest possible photographic speed while reducing dye stain after processing.

In order to characterize the {111} hexagonal tabular grains by quantitative parameters average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. The percentage of the total projective area of all tabular grains with respect to the total projective area of all grains present in the emulsion is calculated from electron microscopic photographs.

Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean aspect ratio of the tabular grains in the emulsion distribution.

Such average crystal diameters for the emulsion crystals present in the light-sensitive layer(s) of the materials according to the present invention are between 0.3 and 3.0 $\mu$m, said grains having two flat parallel {111} crystal faces, accounting for a total projective surface of said parallel crystal faces in said emulsion of at least 50%, more preferably at least 70% and even more preferably more than 90% of the total projective surface area of said grains.

From the average ratios of (equivalent circular) diameter to thickness for each individual tabular grain aspect ratios are determined in order to get ability to further calculate the mean aspect ratio of the tabular grains in the emulsion distribution of the material according to the present invention: said aspect ratio is preferably 5 or more, i.a., from 5:1 up to 50:1 and more preferably from 5:1 up to 20:1.

Not only in favour of image tone as set forth in the objects of the present invention but also in favour of developability it is an essential feature to have a limited amount of iodide, i.a. less than 3 mole % based on silver. More preferably said iodide is present as silver iodide at the grain surface of the tabular grains in order to get an average amount of iodide over the whole grain volume of less than 3 mole % based on silver, preferably less than 1 mole %, even more preferably from 0.05 mole % up to 0.5 mole %, and most preferably in an average amount of from 0.1 mole % up to 0.4 mole %.

The duplitized radiographic film material according to the present invention in the most preferred embodiment thus comprises light-sensitive layers at both sides of the film support wherein the thin {111} tabular silver halide grains rich in silver bromide are containing silver iodide, in limited amounts of from 0.1 mole % up to 0.4 mole %. The {111} tabular grain population in the light-sensitive emulsion is further preferably homogeneous, i.e., has a variation coeffient of less and 0.40 and more preferably even of from 0.10 up to 0.30, based on the equivalent circular diameters calculated for the individual {111} tabular grains.

Preparation methods for {111} tabular grain emulsions rich in silver bromide can be found in Research Dislosure No. 389057, p. 591–639 (1996), more particularly in Chapter I. A very useful method has been described in EP-A 0 843 208. Said {111} tabular hexagonal crystals rich in silver bromide are preferably composed of silver bromoiodide or silver bromochloroiodide (with less than 10 mole % of silver chloride, based on silver). Iodide ions present at the surface of al {111} tabular hexagonal grains are provided in the preparation method by addition of an inorganic iodide salt as potassium iodide. More preferred as providing slower liberation of iodide in the reaction vessel is addition of organic agents releasing iodide ions in order to provide the low silver iodide concentrations, not exceeding 3 mole %, preferably not exceeding 1 mole % and most preferably not exceeding the range from 0.1 mole % up to 0.4 mole % based on silver over het whole grain volume. Addition of iodide by organic agents releasing iodide ions has been described e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663.

In another preferred embodiment addition of iodide to emulsion grains rich in silver bromide is performed by adding fine preformed grains of silver iodide, whether or not including bromide and/or chloride in minor amounts, said grains having a grain diameter of not more than 100 nm, and more preferably, not more than 50 nm. Such fine grains are so-called "Lippmann" emulsions. Addition of iodide making use from such fine grains rich in silver iodide has been described for the preparation of {111} tabular grains in JP-A's 04-251241 and 08-029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of said fine AgI-Lippmann emulsions to the surface of the silver halide crystals in order to get a global iodide content of less than 1 mole % in the grain may advantageously proceed as disclosed in EP-A 0 475 191, wherein an excellent speed/fog ratio and a high covering power are attained.

Preparation of {111} tabular grain emulsions is performed in the presence of gelatin or colloidal silica sol as a binder providing colloidal stability during all preparation steps. In one embodiment the precipitation of the tabular silver halide crystals according to the present invention is performed in the presence of a protective, hydrophilic colloid, e.g. conventional lime-treated or acid treated gelatin but also oxidized gelatin (see e.g. EP-A 0 843 208) or a synthetic peptizer may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, besides dyes (even spectral sensitizing dyes e.g.) or crystal habit modifiers, other grain growth restrainers or accelerators may also be used during the precipitation, together with the flow rate and/or concentration variations of the silver and halide salt solutions, the temperature, pAg, physical ripening time, etc.. Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion can be made free from excess of soluble inorganic salts by a conventional washing technique e.g. flocculation by ammonium sulphate or polystyrene sulphonate, followed by one or more washing and redispersion steps. Another well-known washing technique is ultrafiltration. Finally, extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0 is then obtained.

It is clear that {111} tabular silver halide emulsion grains, present in light-sensitive emulsion layers of materials according to the present invention, are, besides spectrally sensitized, also chemically sensitized, at least with a preferred combination of labile sulphur compounds and gold compounds, more preferably with compounds providing sulphur, selenium or even tellurium and gold. Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds have been disclosed in EP-A's 0 831 363, 0 889 354 and 0 895 121. Said labile selenium compounds are commonly applied in combination with sulphur and gold, and so are labile tellurium compounds as has been disclosed in EP-Application No. 99202439, filed Jul. 23, 1999.

As it is a particularly favorable aspect for materials coated with emulsions having tabular grains in general, and more specifically for materials according to the present invention coated from emulsions having such thin {111} hexagonal tabular grains to be coated with lower amounts of silver without loss of covering power in the material, the total amount of coated silver halide in said film material, expressed as an equivalent amount of silver nitrate, is less than 7 $g/m^2$. In the film material according to the present invention a total amount of coated silver halide in said film, expressed as an equivalent amount of silver nitrate, is more preferably in the range of from 3.0 to 6.0 $g/m^2$.

From an economical (lower amounts of silver used) as well as from an ecological (need for lower amounts of chemicals in the processing and lower silver recovery afterwards) point of view these advantages are remarkable.

It is clear that radiographic film materials coated at only one side (called "single-side" material) of the support, and suitable for use in radiographic applications as mammography can also be provided with light-sensitive emulsion layers having thin hexagonal {111} tabular grains as set forth hereinbefore. Such materials already have the advantage of a better image definition as incident light generated by luminescent phosphors is coming from only one side of the film support and as there is no cross-over as is the case with duplitized films having transparent film supports, exposed from both sides of said support by a pair of screens emitting light from their respective luminescent phosphors.

The duplitized film materials of the present invention are thus irradiated by the light emitted imagewise by X-ray intensifying screens, positioned as a sandwich in intimate contact at both sides of the film coated with light-sensitive emulsion layers having the spectrally and chemically sensitized thin hexagonal {111} tabular grains, after conversion of X-rays passing through the patient.

A diagnostic silver image, in conformity with the X-ray image, is obtained after processing of the film material according to the present invention. For use in common medical radiography (projection radiography) the X-ray film material comprises a transparent film support, coated on both sides with at least one silver halide emulsion layer, further overcoated with at least one protective antistress layer and, optionally, an afterlayer as disclosed e.g. in EP-A's 0 644 454 and 0 644 456. It is further advised to add to the protective antistress layer(s), besides the normally added components (see Examples) a mercapto tetrazole compound, preferably a substituted 1-phenyl 5-mercaptotetrazole compound in exceptionally huge amounts of at least 0.5 mmole per mole of coated silver halide, and even up to an amount 10 mmole. It has namely been established that the presence of such compounds in the protective antistress layer(s) further improves image tone in that a "colder" blue-black image is obtained for at least the same and even an increased covering power.

During the X-ray irradiation said film is thus arranged in a cassette between two X-ray intensifying screens, both of them making contact with the corresponding light-sensitive side(s), thus forming a film/screen system.

In one embodiment according to the present invention a radiographic screen/film combination or system is thus provided comprising a duplitized film material, in contact with or sandwiched between a pair of supported or self-supporting X-ray intensifying screens, characterized in that i) supported or self-supporting X-ray intensifying screens essentially consist of luminescent phosphor particles emitting at least 50% and more preferably at least 80% of their emitted radiation in the blue/ultraviolet and/or green wavelength range, more particularly in the green wavelength range of from 500 nm to 550 nm, as e.g. a terbium doped gadolinium oxisulfide phosphor;

ii) said film material according to the present invention comprise, in the light-sensitive layers, one or more {111} tabular silver halide emulsion(s) as set forth hereinbefore, comprising said thin hexagonal {111} tabular grains rich in silver bromide, spectrally sensitive to irradiation in the preferred wavelength range, said preferred wavelength range being from 500 to 550 nm by the presence of at least one J-aggregating (green) spectral sensitizer according to the general formula (II).

In the context of the present invention, more particularly with respect to the purposes to get reduced dye stain besides an excellent image tone, said reduced dye stain delivering an indispensible asset thereto, azacyanine dyes according to the general formulae (I.1) and (I.2) should be used in the said high amounts during the preparation of {111} tabular grain emulsions as the presence of said dyes not only has a site-directing function, but as it also permits further addition of the J-aggregating spectral sensitizers according to the general formula (II) in lower amounts, without loss in speed, thereby providing better decoloration in the processing. J-aggregating spectral sensitizers suitable for spectrally sensitizing emulsions in materials of the present invention have in part been described by F. M. Hamer in "The Cyanine Dyes and Related Compounds", 1964, John Wiley & Sons, while other examples have been given in Research Disclosure Item 22534 and in a more recent overview in EP-A 0 757 285, wherefrom dyes forming J-aggregates on the flat surface of the preferred silver bromoiodide or silver bromochloroiodide crystals are particularly useful.

According to the present invention, in a particular embodiment, a radiographic screen/film combination is thus provided comprising the light-sensitive silver halide photographic film material as set forth above in combination with a supporting or self-supporting X-ray intensifying screen, characterized in that said supported or self-supporting X-ray intensifying screen essentially consists of luminescent phosphor particles emitting green light irradiation in the wavelength range between 540 and 555 nm.

Beside spectrally sensitizing dyes other dyes, which per se do not have any spectral sensitization activity, or certain other compounds, which do not substantially absorb visible radiation, can be added in order to provide a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as e.g. an antihalation undercoat layer between a subbing layer, providing good adhesion between the support and adjacent layers, and a light-sensitive emulsion layer. The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating compo-sition "in situ" just before coating it onto the supporting layer. A more recent review of dispersion methods, useful in the context of the present application has been described in EP-A 0 756 201.

The silver halide emulsions used in light-sensitive layers of the material according to the present invention may further comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl-esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex, or antistatic agents providing permanent electronic conductivity such as polyethylene dioxythiophenes described e.g. in U.S. Pat. No. 5,395,472 and EP-A 1 031 875.

During X-ray irradiation of the radiographic film material of the present invention said film material (made spectrally sensitive—e.g. to green light as in a preferred embodiment—by suitable spectral sensitization of its light-sensitive emulsion grains) is thus arranged in a cassette with X-ray intensifying screen (emitting green light by presence of suitable green-light emitting luminescent phosphors). For chest radiography said cassette is provided with two X-ray intensifying screens making contact with two X-ray intensifying screens, being the same or different. When two intensifying screens are used it is not excluded to use two identical screens (having same radiation sensitivity), to use two screens emitting the same irradiation but differing in speed, e.g. due to different coating amounts of phosphors (coating thickness), or even to use two intensifying screens having a different light emission. So combination of an intensifying screen sensitive to blue/UV-irradiation and a screen sensitive to green light is not excluded and may be favorable in order to attain desired properties with respect to sensitometry (desired sensitometric curve from the point of diagnostic view) and/or image quality (granularity and/or image definition, particularly sharpness).

Specific intensifying screens or conversion screens emitting green (or blue light as in very particular applications with non-symmetric screens and (a)symmetric duplitized films in screen/film combinations for use in the diagnostic image forming method according to the present invention are the commercially available X-ray generating devices providing an exposure to X-rays with a tube voltage from 20 up to 40 kV (as in mammography) and from 70 kV up to 100 kV (as in chest radiography). It is always desired to expose the patient to a low X-ray dose, if possible, so that exposure to low voltage sources is not excluded and even recommended.

A preferred luminescent phosphor coated in the X-ray conversion screen used in a film/screen system sensitive to green light is $Gd_2O_2S$:Tb, emitting light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention. Otherwise in the particular application wherein a blue/UV emitting screen is used at one side, said screen is provided with blue/UV emitting luminescent phosphor particles emitting at least 50% and more preferably at least 80% of their emitted radiation in the wavelength range shorter than 420 nm, use can be made of the specific intensifying screens emitting ultraviolet-blue radiation as disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing $CaWO_4$ as representative for an older well-known generation of luminescent phosphors. Very useful phosphor particles have e.g. been disclosed in EP-A 0 820 069 wherein particles of niobium doped, monoclinic M, yttriumtantalate phosphor and particles of an europium doped bariumfluorohalide phosphor are composing the screen. Phosphor particles having niobium and gadolinium doped, monoclinic M, yttriumtantalate (MYT) phosphor according to formula $YTaO_4$:Gd:Nb are particularly useful.

The thickness of the phosphor layer therein depends on the amount of coated phosphor required in order to obtain the desired screen speed. X-ray intensifying screens used in the film/screen system according to the present invention can be self-supporting or supported. X-ray intensifying screens in the screen/film system according to the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

X-ray intensifying screens in the film/screen system according the present invention can be self-supporting or supported. X-ray intensifying screens generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used as described e.g. in U.S. Pat. No. 5,381,015. Such supports can be highly light reflecting as e.g. polyethylene terephthalate comprising a white pigment, e.g. $BaSO_4$, $TiO_2$, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention. In most applications the phosphor layers contain sufficient binder to give structural coherence to the layer.

A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11.

The screen used in a screen/film system according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer.

After the formation of the fluorescent layer, a protective layer is generally provided on top of the fluorescent layer. In a preferred embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage as described in EP-A's 0 510 753 and 0 510 754. Assemblies providing means for reducing cross-over to less than 10% for radiation longer than 300 nm in wavelength have been described e.g. in U.S. Pat. No. 5,259,016.

According to the present invention a black-and-white image-forming method has thus been provided, said method comprising the steps of contacting the film material according to the the present invention between a sandwich of a pair of supported or self-supporting X-ray intensifying screens , wherein said pair of supported or self-supporting X-ray intensifying screens comprises luminescent phosphor particles emitting at least 50% of their emitted radiation in the wavelength range for which said material has been made spectrally sensitive; exposing the film to X-rays passing a subject to be examined, (said X-rays having an energy of e.g. from 70 to 100 keV while being in contact with the said screens and preferably having a lower energy); and processing the film by the steps of developing, fixing, rinsing and drying.

The said processing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present.

As ecology and low replenishing amounts are main topics with respect to the present invention use is made of concentrated hardener free processing solutions in one single package.

Examples thereof have been disclosed e.g. in U.S. Pat. Nos. 5,187,050 and 5,296,342. Especially preferred developers comprising ecologically acceptable developing agents such as ascorbic acid and derivatives thereof have been described in EP-A 0 732 619 and in U.S. Pat. No. 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented. In order to reduce "sludge formation" which is favored by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer. Suitable measures taken therefore have recently been described in the EP-Applications Nos. 99201891 and 99201892, both filed simultaneously Jun. 14, 1999.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of α-ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

It is clear that although use of hexagonal {111} tabular emulsion grains in a duplitized material as in the present invention is claimed, it does however not exclude use of such emulsions in single-side coated materials, whether or not in radiographic applications (as already set forth hereinbefore) such as in combination with a single screen having luminescent phosphors with a high prompt emission of fluorescent light on X-ray irradiation and low afterglow in favour of image sharpness used in mammography, wherefore the relationship between resolution and speed of X-ray intensifying screens has been described e.g. in Med. Phys. 5(3), 205 (1978)). Other single-side coated materials wherein the emulsions as set forth hereinbefore can advantageously applied, e.g. with respect to preservation properties, developability, etc. are black-and-white silver halide material used e.g. in micrography, in aviation photography, in black-and-white cinefilms, in laserfilms or hardcopy films and in graphic or reprographic applications. Even use thereof in color photographic applications may be useful.

Having described in detail preferred embodiments of the present invention it is understood by a person skilled in the art that, within the scope of the present invention, it is not limited thereto, just as the following examples illustrating the present invention.

EXAMPLES

Example 1

Preparation of tabular emulsion A

To a solution of 6.9 g of an oxidized gelatin in 3 l of demineralized water at 51° C., adjusted to a pH of 2.5 by adding $H_2SO_4$, stirred up to a rate of 600 r.p.m., were added by a double jet method aqueous solutions of 0.98 M $AgNO_3$ (hereinafter referred to as A1) and 0.98 M KBr (hereinafter referred to as B1): 25 ml of A1 and 25 ml of B1 were added in a time interval of 30 seconds. When the addition was completed, the temperature was increased up to 70° C. over a period of 30 minutes: UAg was controlled (expressed in mV versus a Ag/AgCl(sat.) reference electrode and should be in the range from 44.5±5 mV at a temperature of 70° C.±1° C. 1 minute later pH was set to a value of 5.0±0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min.). In a further double jet addition A1 and B1 were added during 2822 seconds at a linearly increasing rate going from 7.0 up to 21.11 ml/min. for Al and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the flow rate up to 46.49 ml/min. and 46.69 ml/min. respectively over a total time period of 81 min. and 5 seconds.

After that double-jet addition period, an amount of an emulsion having ultrafine (ca. 0.040 μm) 100% AgI crystals, dissolved in 20 g of demineralized water at 40° C., was added to the reaction vessel in order to get a total AgI content at the end of precipitation of 0.1 mole % vs. silver precipitated.

The average grain size of the silver bromoioide tabular {111} emulsion grains thus prepared, expressed as equivalent volume diameter, was 0.53 μm, the average thickness was 0.12 μm.

After washing, gelatin and water were added in order to obtain a silver halide content of 230.5 g/kg, expressed as $AgNO_3$, and a gelatin content of 72.6 g/kg. The emulsion having a weight of 3442 g, the pH of which was adjusted to 5.5, was divided into 10 equal parts. To each part were added consecutively 4 ml of a 1 wt. % KSCN solution, x ml (0.4 wt %) of the azacyanine dye corresponding with the formula as set forth hereinafter dissolved in 18 ml of methanol, followed by addition , after 5 minutes of 2 ml of a $4.76\times10^{-5}$ M solution of sodium toluenethiosulphonate in methanol, further followed by addition after 5 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, y mg of sodium thiosulphate dissolved in 10 ml of demineralized water at 35° C., z ml of a 0.001 wt. % solution of 2-carboxyethyl-N-benzothiazine selenide, w ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole.

The 10 emulsion samples for which values of x, y, z and w have been given in Table 1 were chemically ripened at 50° C. during a time in order to get the best compromise between fog and sensitivity. After cooling phenol was added as a preservative.

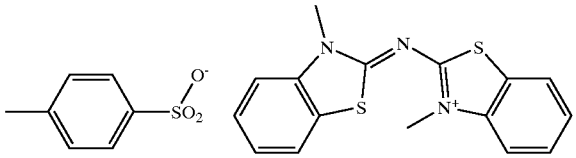

see formula (I.3)—but with counterion as in (I.5) hereinbef ore

TABLE 1

| Em.No | 1 | 2 | 3 | 4 | 5 | 6 | 7 | 8 | 9 | 10 |
|---|---|---|---|---|---|---|---|---|---|---|
| X | 7.2 | 7.2 | 7.2 | 7.2 | 7.2 | 50.0 | 50.0 | 50.0 | 50.0 | 50.0 |
| Y | 7 | 7 | 6 | 6 | 7 | 7 | 6 | 6 | 5 | 5 |

TABLE 1-continued

| Em.No | 1 | 2 | 3 | 4 | 5 | 6 | 7 | 8 | 9 | 10 |
|---|---|---|---|---|---|---|---|---|---|---|
| Z | 8 | 8 | 7 | 7 | 8 | 8 | 7 | 7 | 7 | 7 |
| W | 9 | 12 | 7 | 9 | 9 | 12 | 9 | 12 | 9 | 12 |

Following coating agents, summarized in Table 2, were added to the emulsion before coating the emulsion layer:

TABLE 2

| Compound (amounts per mole silver halide) | Emulsion layer |
|---|---|
| 5,5'-dichloro-3,3'-bis(n-butyl-4-sulphonate)-9-ethylbenzoxacarbocyanine, anhydrous triethylammonium salt | 50 mg |
| 4-hydroxy-6-methyl-1,3,3a,7-tetraazaindene | 87 mg |
| bis-metasulphophenyl-disulphide | — |
| 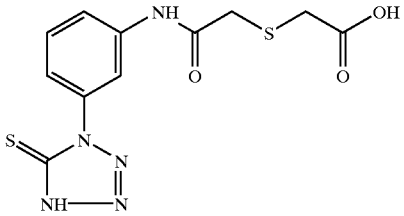 | 33 mg |
| Sorbitol | 15.5 g |
| polyethylacrylate, latex plasticizer | 12 g |
| Phloroglucinol | 195 mg |
| Resorcinol | 2.8 g |
| potassium bromide | 160 mg |
| polydextran (M.W. 10,000) | 15 g |

The following protective layer was coated thereupon (pH value: 6.25) at both sides (see Table 3):

TABLE 3

| Composition of the protective antistress layer | |
|---|---|
| Gelatin | 1.11 g/m$^2$ |
| Graft copolymer (1) | 14 mg/m$^2$ |
| Chromium acetic acid | 7.3 mg/m$^2$ |
| Compound (2) | 16 mg/m$^2$ |
| Compound (3) | 6.7 mg/m$^2$ |
| Mobilcer Q (MMM trademarked product) | 9 ml/m$^2$ |
| Compound (4) | 15 mg/m$^2$ |
| Compound (5) | 40 mg/m$^2$ |

Compound (1)

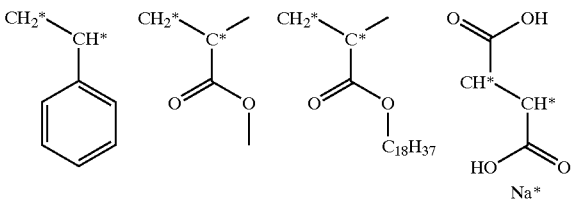

Compound (2)

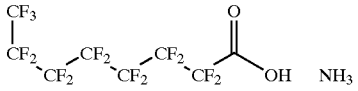

-continued

Compound (3)

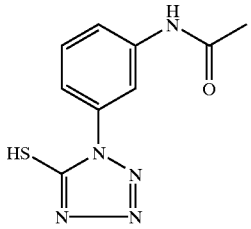

Compound (4)

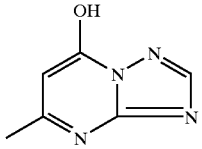

Compound (5)

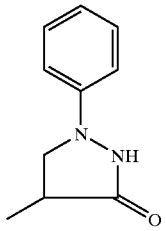

The photographic materials according to these examples comprise one emulsion layer and one protective layer. The coating solutions of the emulsion layers were prepared by adding solutions of the compounds indicated in Table 2 to the melted chemically ripened emulsion samples Nos 1–10 while stirring. The coating solution of the protective layer is given in Table 3.

After adjusting pH to 6.7, the viscosity and surface tension of the coating solutions were optimized according to the requirements of the coating method. The emulsion layer(s) and the protective layer were coated simultaneously on one side of a substrated polyester support having a thickness of 175 $\mu$m by means of conventional coating techniques. The silver coverage of the emulsions was about 5–5.5 g/m$^2$, expressed as an equivalent amount of silver nitrate.

Separate strips of the coated materials were subsequently exposed for the same exposure time of 2 seconds to white light, filtered with a U535-green light filter. Development proceeded for 12 seconds in a developer having the following composition:

| | |
|---|---|
| hydroquinone | 30 g |
| 1-phenyl-pyrazolidine-3-one | 1.5 g |
| acetic acid 99% | 9.5 ml |
| potassiumsulphite | 63.7 g |
| potassiumchloride | 0.8 g |
| EDTA-2Na | 2.1 g |
| potassium carbonate | 32 g |
| potassiummetabisulfite | 9 g |
| potassium hydroxyde | 14 g |
| diethyleneglycol | 25 ml |
| 6-methylbenztriazol | 0.09 g |
| glutardialdehyde 50 wt % | 9.5 ml |
| 5-nitroindazole | 0.25 g |
| demineralized water to make 1 1. | |

The starter solution to be added had the following composition:

| | |
|---|---|
| acetic acid 99% | 15.5 ml |
| KBr | 16 g |
| demineralized water up to 100 ml | |

Hereupon, the developed photographic strips were fixed in a conventional fixing bath comprising e.g. sodium thiosulfate and potassium metabisulfite, and then rinsed in water and allowed to dry.

Sensitometric properties of these film strips are given in Table 4, wherein the sensitometric results have been shown in terms of fog F (figures multiplied by a factor of 1000), speed S (figures multiplied with a factor of 100: the lower the figure, the more sensitive is the emulsion; lowering with 30 units is equivalent with a doubling in speed), overall contrast GG (figures multiplied with a factor of 100, the gradation was measured from the characteristic curve over a density range of 1.75 starting from a density value of 0.25 up to 2.00 above fog) and covering power CP, calculated as maximum density per gram of coated silver. Sensitometric data were obtained by developing in a developer having a composition as indicated above during an overall developing time of 12 seconds.

Moreover image tone was evaluated and represented as "IT", from figures corresponding with $D_r$ wherefore data are summarized with respect to the density $D_r$ measured through a red filter at a density $D_b$=2 behind a blue filter: the higher this value (figure multiplied by a factor of 100), the better (more desired blue-black instead of undesired red-brown) is the color of the developed silver. Differences of 0.02 are considered to be significant as being visually perceptible.

TABLE 4

| Matl.No. | F | S | GG | CP | IT | $AgNO_3/m^2$ |
|---|---|---|---|---|---|---|
| 1(comp.) | 208 | 228 | 197 | 56 | 194 | 5.27 g |
| 2(comp.) | 201 | 232 | 206 | 60 | 194 | 4.91 g |
| 3(comp.) | 201 | 228 | 215 | 63 | 194 | 4.97 g |
| 4(comp.) | 202 | 252 | 180 | 49 | 194 | 4.85 g |
| 5(comp.) | 197 | 248 | 188 | 51 | 194 | 4.89 g |
| 6 (inv.) | 208 | 154 | 306 | 83 | 195 | 4.90 g |
| 7 (inv.) | 203 | 157 | 321 | 76 | 195 | 5.05 g |
| 8 (inv.) | 202 | 155 | 323 | 78 | 195 | 5.06 g |
| 9 (inv.) | 201 | 161 | 325 | 80 | 195 | 5.00 g |
| 10 (inv.) | 203 | 152 | 314 | 80 | 195 | 5.09 g |

As can be concluded from the Table 4 the presence in the light-sensitive silver halide photographic emulsions of high enough an amount of azacyanine as site-directing compound in the chemical sensitization of the thin tabular {111} silver bromoiodide grains provides the desired high speed, high contrast and enhanced covering power without loss in image tone. Moreover said image tone looks even slightly better, based on the figures obtained. The comparative emulsions and corresponding materials Nos. 1–5 are clearly inferior if compared with the inventive emulsions and corresponding materials Nos. 6–10: besides the spectacular increase in speed (up to 8 times!), a tremendous increase in covering power is attained without deterioration of the image tone. It may be concluded that these results are at least illustrative for a break-through in the relationship thus obtained between covering power and image tone.

Due to the presence of such high amounts of site-directing compound—see formula (I.3)—but with counterion as in (I.5) hereinbefore—a small hypsochromic shift in absorption maximum of the materials for visible (green) light is obtained from 547 nm (comparative materials) to 544 nm (inventive materials), without however having other negative consequences, as e.g. on attainable speed.

Example 2

The same emulsion as in Example 1 was prepared again.

After washing, gelatin and water were added in order to obtain a silver halide content of 230.5 g/kg, expressed as $AgNO_3$, and a gelatin content of 72.6 g/kg. The emulsion the pH of which was adjusted to 5.5, was divided into 4 equal parts, numbered Emulsion Nos. 11–14. To each part were added consecutively, per equivalent amount of 500 g of silver nitrate, 4 ml of a 1 wt. % KSCN solution, x ml (1 wt %) of the azacyanine dye corresponding with the same formula as in Example 1 dissolved in 18 ml of methanol, followed by addition, after 5 minutes of 2 ml of a $4.76\times10^{-5}$ M solution of sodium toluenethiosulphonate in methanol, further followed by addition after 5 minutes of w' ml of a 0.25 wt. % solution of anhydro-5,5'-dichloro-3,3'-bis(n-propyl-3-sulphonate)-9-ethyl-benzoxa-carbocyanine triethylammonium salt, 5.5 mg of sodium thiosulphate dissolved in 10 ml of demineralized water at 35° C., 7 ml of a 0.001 wt. % solution of 2-carboxyethyl-N-benzothiazine selenide, 9.0 ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole.

TABLE 5

| Em.No | 11 | 12 | 13 | 14 |
|---|---|---|---|---|
| X | 75 | 100 | 75 | 100 |
| w' | 1200 | 1000 | 1000 | 1000 |

Same coatings in amounts equivalent with about 5 g $AgNO_3$ per sq.m. (see following Table 6) were prepared as in Example 1 and the strips thus obtained were numbered Materials Nos. 11–14. After exposure and processing, just as in Example 1, following results, summarized in Table 6 were obtained.

As can be concluded from the data in the Table 6 hereinafter higher amounts of azacyanine dyes permit addition of lower amounts of spectral sensitizer without impairing sensitometry, which moreover favorably attributes to better decoloration and less residual color after processing. The trend to an improved image tone and an improved relation between image tone and covering power is clearly confirmed when such high amounts of azacyanine dye are added.

TABLE 6

| Matl.No. | F | S | GG | CP | IT | $AgNO_3/m^2$ |
|---|---|---|---|---|---|---|
| 11 (inv.) | 199 | 156 | 331 | 76 | 195 | 5.32 g |
| 12 (inv.) | 201 | 160 | 330 | 76 | 196 | 5.37 9 |
| 13 (inv.) | 202 | 152 | 315 | 76 | 195 | 5.01 g |
| 14 (inv.) | 207 | 155 | 310 | 76 | 196 | 5.36 g |

Example 3

Preparation of Tabular Emulsion A'

To a solution of 7.5 g of an oxidized gelatin in 3 1 of demineralized water at 55° C., adjusted to a pH of 2.0 by adding $H_2SO_4$, stirred up to a rate of 600 r.p.m., were added by a double jet method aqueous solutions of 0.98 M $AgNO_3$ (hereinafter referred to as A1) and 0.98 M KBr (hereinafter referred to as B1): 30 ml of A1 and 30 ml of B1 were added in a time interval of 30 seconds. The temperature was increased up to 70° C. over a period of 32 minutes: UAg was controlled and should be in the range from 44.5±5 mV (measured versus a Ag/AgCl(sat.) reference electrode. pH was set to a value of 5.0±0.3 and immediately thereafter a solution of 50 g of inert gelatin in 500 ml of demineralized water of 70° C. was added.

3 minutes later B1 was added at a rate of 7 ml/min. during 120 seconds, while simultaneously adding by double jet A1 at a rate of 7.23 ml/min. In a further double jet addition A1 and B1 were added during 2808 seconds at a linearly increasing rate going from 7.0 up to 21.11 ml/min. for A1 and from 7.23 up to 21.74 ml/min. for B1 in order to maintain a constant UAg potential of +10 mV in the reaction vessel. After 4 minutes 22 seconds A1 and B1 were simultaneously added by double-jet addition during 60 seconds at a rate of 10.0 and 10.14 ml/min. respectively time during which the UAg value was held at a constant value of 30 mV, further increasing the flow rate up to 46.39 ml/min. and 47.04 ml/min. respectively over a total time period of 80 min. and 52 seconds.

After that double-jet addition period, an amount of an emulsion having ultrafine (ca. 0.040 μm) 100% AgI crystals, dissolved in 20 g of demineralized water at 40° C., was added to the reaction vessel in a tim of 2 minutes in order to get a total AgI content at the end of precipitation of 0.1 mole % vs. silver precipitated.

The average grain size of the silver bromoioide tabular {111} emulsion grains thus prepared, expressed as equivalent volume diameter, was 0.43 μm, the average thickness was 0.09 μm.

After washing, gelatin and water were added in order to obtain a silver halide content of 230.5 g/kg, expressed as $AgNO_3$, and a gelatin content of 72.6 g/kg. The emulsion having a weight of 3442 g, the pH of which was adjusted to 5.5, was divided into 10 equal parts. To each part were added consecutively 4 ml of a 1 wt. % KSCN solution, xml (0.4 wt %) of the azacyanine dye corresponding with the formula as set forth hereinafter—see also Example 1 dissolved in 18 ml of methanol, followed by addition, after 5 minutes of 2 ml of a $4.76\times10^{-1}$ M solution of sodium toluenethiosulphonate in methanol, further followed by addition after 5 minutes of y' ml of a 0.25 wt. % solution of anhydro-5,5'-dichloro-3,3'-bis(n-propyl-3-sulphonate)-9-ethyl-benzoxacarbocyanine triethylammonium salt, amounts of sodium thiosulphate, 2-carboxyethyl-N-benzothiazine selenide and chloro auric acid (including ammonium thiocyanate) in order to get an optimized fog-speed relationship. Finally 10 ml of a 1 wt. % solution of 1-(p-carboxyphenyl)-5-mercapto-tetrazole were added.

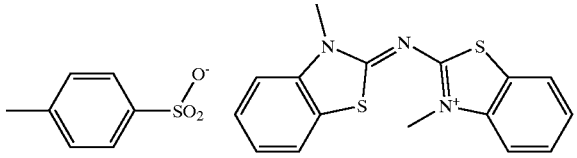

see formula (I.3)—but with counterion as in (I.5)

Seven emulsion samples for which values of x and y' have been given in Table 5 were chemically ripened at 50° C. during a time in order to get the best compromise between fog and sensitivity. After cooling phenol was added as a preservative. Coatings (at an average coating amount of about 4 g, expressed as equivalent amount of silver nitrate) were performed, just as for Materials Nos. 1–10 in Example 1: Materials Nos. 15–21 were exposed, processed and evaluated in the same way as in Example 1.

Results obtained for Fog, Speed, Covering Power, Image Tone and Cross-Over % have been summarized in Table 7.

The cross-over percentage (C.O. %) was determined as follows. Double side coated samples were adjusted between a single green light emitting screen (CURIX Ortho Regular, trademarked product from Agfa-Gevaert NV, Mortsel, Belgium) and a white paper replacing the second screen. This film-screen element directed with its light emitting screen to the X-ray tube, was exposed with varying radiation doses, expressed as log E(xposure). After processing the minimum dose needed to obtain a density of 0.5 above fog was determined from the front layer (log $E_{front}$) and from the back layer (log $E_{back}$) separately. The cross-over percentage was then calculated from the following equation:

$$\%\ C.O.=100:\ \text{antilog}\ (\log E_{back}-\log E_{front})$$

TABLE 7

| Matl.No. | x | y' | F | S | % CO | CP | IT |
|---|---|---|---|---|---|---|---|
| 15(comp.) | 0 | 1200 | 206 | 195 | 39 | 65 | 189 |
| 16(inv.) | 108 | 1200 | 211 | 173 | 38 | 75 | 189 |
| 17(comp.) | 0 | 1350 | 213 | 178 | 34 | 71 | 189 |
| 18(comp.) | 0 | 1500 | 210 | 180 | 33 | 71 | 189 |
| 19(inv.) | 108 | 1500 | 205 | 164 | 35 | 81 | 187 |
| 20(comp.) | 0 | 1650 | 208 | 189 | 27 | 75 | 187 |
| 21(comp.) | 0 | 1800 | 197 | 201 | 29 | 80 | 187 |

From the data summarized in Table 7 it can be concluded that an optimized speed is attainable for materials having ultrathin {111} tabular grains when besides high amounts of azacyanine site-directing compounds (at least 0.1 mmole per mole of silver) high amounts of green sensitizing dyes are present (see inventive Examples Matl. No. 19 versus No. 16).

No negative effect on cross-over percentage (representative for image sharpness) is attained (compare Materials Nos. 19 and 20) and besides a good to comparable image tone for both inventive samples, an outstanding covering power is calculated.

It can thus be concluded that an increase in covering power does not negatively influence image tone of the image obtained after processing.

Having described in detail preferred embodiments of the current invention, it will now be apparent to those skilled in the art that numerous modifications can be made therein without departing from the scope of the invention as defined in the following claims.

What is claimed is:

1. Light-sensitive silver halide photographic film material comprising a transparent support and on one or both sides thereof at least one light-sensitive emulsion layer having spectrally and chemically sensitized tabular silver halide grains rich in silver bromide, wherein said grains rich in silver bromide have iodide in an amount of from 0.1 mole % up to 0.4 mole %, based on silver, with two flat parallel {111} crystal faces, said grains accounting for a total projective surface of said parallel crystal faces in said emulsion of at least 50%, further having an average aspect ratio of at least 2:1, a grain thickness of from 0.05 up to 0.15 μm, a site-directing compound satisfying general formula (I.1) or (I.2) in an amount of not less than $1\times10^{-4}$ mole per mole of silver coated and one or more J-aggregating spectrally sensitizing dye(s), wherein a molar ratio amount between said site directing compound and said J-aggregating spectrally sensitizing dye(s) is at least 1:6 for a grain coverage of said {111} tabular grains exceeding 50% and wherein said site-directing compounds are represented by the formula (I.1) or (I.2)

(I.1)

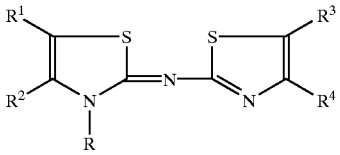

(I.2)

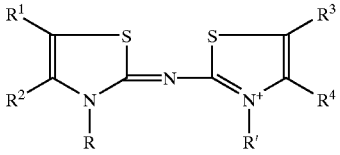

wherein each of the substituents $R^1$–$R^4$ independently represents hydrogen, an alkyl, an aryl or an aralkyl;

wherein $R^1$ and $R^2$ and/or $R^3$ and $R^4$ may form a benzoring, which, if substituted, has the same or different substituents as $R^1$–$R^4$; wherein R represents an alkyl, an aryl or an aralkyl group; wherein R' represents hydrogen, an alkyl, an aryl or an aralkyl group; and wherein cations or anions are present as charge compensating ions.

2. Material according to claim 1, wherein said molar ratio between site-directing compound and J-aggregating spectrally sensitizing dye(s) is from 1:3 to 1:1.

3. Material according to claim 1, wherein in formula (I.1) or (I.2) each of R and R' independently represents $(CH_2)_nH$ or $(CH_2)_nOH$, n being an integer having a value from 1 to 4;

$(CH_2)_m(SO_3^-)$ or $(CH_2)_mO(SO_3^-)$, m being an integer having a value from 2 to 4;

$(CH_2)_2CH(Y)SO_3^-$ wherein Y represents $CH_3^-$, —Cl or —OH;

$(CH_2)_n(COO^-)$ or $(CH_2)_n(COOH)$;

$(CH_2)_sSO_2^-(CH_2)_tH$ wherein s equals 2 or 3 and t equals 1 or 2;

$(CH_2)_x$-Phen-W, wherein W represents $—COO^-$ or $SO_3^-$;

Phen represents phenyl which is substituted or unsubstituted, and x equals 1, 2, 3 or 4;

$(CH_2)_nCONHSO_2H$, or $(CH_2)_{m'}—(C{=}O)—O—CH_2—(C{=}O)—CH_3$, wherein m' is an integer having a value of from 1 to 5.

4. Material according to claim 1, wherein said {111} tabular silver halide grains have an aspect ratio of at least 5:1, an average crystal diameter between 0.3 $\mu$m and 3.0 $\mu$m and account for at least 50% of the total projective surface area of said grains.

5. Material according to claim 1, wherein said silver halide grains are sensitive to irradiation in the wavelength range between 540 and 555 nm by the presence of a J-aggregating spectrally sensitizing cyanine dye corresponding to the general formula (II)

(II)

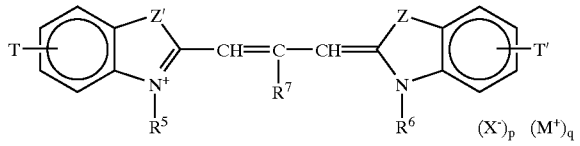

wherein

Z and Z' each independently represents a nitrogen or an oxygen atom and wherein Z is substituted with $R^8$ if Z is a nitrogen atom and Z' is substituted with $R^9$ if Z' is a nitrogen atom;

$R^5$, $R^6$ and $R^8$ and $R^9$ each independently represents an alkyl, $R^7$ represents hydrogen, an alkyl or aryl, T and T' may each independently represent hydrogen, an alkyl, an aryl or a heterocyclic group;

$(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound.

6. Material according to claim 1, wherein a total amount of coated silver halide in said film, expressed as an equivalent amount of silver nitrate, is in the range from 3.0 to 6.0 $g/m^2$.

7. Radiographic screen/film combination comprising the light-sensitive silver halide photographic film material according to claim 1, in combination with a supporting or self-supporting X-ray intensifying screen, characterized in that said supported or self-supporting X-ray intensifying screen essentially consists of luminescent phosphor particles emitting green light irradiation in the wavelength range between 540 and 555 nm.

8. Radiographic screen/film combination according to claim 7, wherein said luminescent phosphor is $Gd_2O_2S$:Tb.

9. Black-and-white image-forming method comprising the steps of contacting the film material according to claim 1 between a sandwich of a pair of supported or self-supporting X-ray intensifying screens, wherein said pair of supported or self-supporting X-ray intensifying screens comprises luminescent phosphor particles emitting at least 50% of their emitted radiation in the wavelength range for which said material has been made spectrally sensitive;

exposing the said film material to X-rays passing a subject to be examined, said X-rays having an energy from 70 to 100 keV while being in contact with the said screens;

processing the film material by the steps of developing, fixing, rinsing and drying.

* * * * *